US005446667A

United States Patent [19]

Oh et al.

[11] Patent Number: 5,446,667

[45] Date of Patent: Aug. 29, 1995

[54] JUST-IN-TIME MAIL DELIVERY SYSTEM AND METHOD

[75] Inventors: Je H. Oh, Stamford; William M. Hunt, Shelton; Ronald P. Sansone, Weston, all of Conn.

[73] Assignee: Pitney Bowes Inc., Stamford, Conn.

[21] Appl. No.: 900,397

[22] Filed: Jun. 18, 1992

[51] Int. Cl.[6] ..... G07B 17/00

[52] U.S. Cl. ..... 364/464.02; 364/478

[58] Field of Search ..... 209/584, 900; 364/464.02, 464.03, 478

[56] References Cited

U.S. PATENT DOCUMENTS

| | | | |
|---|---|---|---|
| 3,573,748 | 4/1971 | Holme | 209/900 |
| 5,072,401 | 12/1991 | Sansone et al. | 364/401 X |
| 5,119,306 | 6/1992 | Metelits et al. | 364/464.02 |
| 5,216,620 | 6/1993 | Sansone | 364/478 |
| 5,237,508 | 8/1993 | Furukawa et al. | 364/478 X |
| 5,278,750 | 1/1994 | Kaneko et al. | 364/401 |

FOREIGN PATENT DOCUMENTS

| | | |
|---|---|---|
| 0095737 | 12/1983 | European Pat. Off. . |
| 0424728 | 5/1991 | European Pat. Off. . |

*Primary Examiner*—Edward R. Cosimano

*Attorney, Agent, or Firm*—Peter Vrahotes; Melvin J. Scolnick

[57] ABSTRACT

A system and method for reducing the amount of mail that is submitted to a local post office and reducing the effort required by a local post office. A mailer sorts mail and separates local mail from non local mail, identifies the destination of the non local mail and puts the same in a tray in accordance with the destination thereof. The mail destined for each destination is processed in accordance with the departure time of a transportation system so that the mail will be received just-in-time by a common carrier. The non local mail is then forwarded to the common carrier by the mailer and the common carrier delivers the mail to a transport vehicle destined for a postal distribution center.

3 Claims, 2 Drawing Sheets

JUST-IN-TIME MAIL DELIVERY SYSTEM AND METHOD

RELATED CASES

Attention is directed to U.S. Pat. No. 5,119,306 filed Jan. 2, 1990 and entitled Mail Piece Weight Quality Control System and Method; U.S. Pat. No. 5,329,102 filed Oct. 9, 1990, entitled Method and Apparatus for Preparing Validated Mail Tray Labels; U.S. patent application Ser. No. 641,985 filed Jan. 16, 1991 and entitled Postal Automated Labeling System which was abandoned in favor of a continuing application Ser. No. 07/963,013 filed Oct. 19, 1992, which was abandoned in favor of a continuing application Ser. No. 08/181,476 filed on Dec. 12, 1993 and which is still pending; and U.S. Pat. No. 5,216,620 filed Sep. 23, 1991 and entitled Requesting, Reporting and Verification System and Method for Mail Carrier Payment.

BACKGROUND OF THE INVENTION

Throughout the history of the mail delivery, there has been a gradual evolution whereby the post office encourages mailers to prepare their mail in such a way as to reduce the effort required on the part of the post office for processing such mail. As an inducement to the mailer to prepare the mail in such a way so as to bring about faster mail delivery, the post office offers a postage discount to mailers for such items as presorted mail and printing of nine digit zip codes. Discounts are also given when the mail is produced in a manner allowing automatic processing with machines such as optical character recognition (OCR) sorters and bar code readers and sorters.

Even with present mail processing techniques that have come into being as a result of reduced postage rates for presorted mail, zip code mail and the like, the post office is still experiencing difficulties in meeting targeted delivery times for the mail. The primary reason for such difficulties is the increase in volume of mail that has taken place over the decades.

Systems and methods have been conceived and described wherein the efforts required by the post office to process mail has been reduced. One of the problems the post office faced previously was that a significant amount of mail presented to the post office did not have the required postage or did not meet the requirements of postal regulations. A scheme for overcoming this problem was disclosed in U.S. patent application Ser. No. 07/594,515, supra. In that patent application, a scheme is disclosed whereby mail is processed in such a manner that the mail is sorted to separate the local mail from the non local mail, the non local mail is placed into trays in accordance with their zip codes and a label is printed that identifies the mail in the tray for subsequent processing. As a part of this scheme, the post office is given a running account of the mail being processed so that postage can be accurately determined and the post office is able to process the mail further without having to inspect the same to assure proper payment.

U.S. patent application Ser. No. 641,985, supra, discloses a system whereby labels can be printed by a mailer for the trays and the sacks into which mail is placed for a common carrier, particularly an air carrier. U.S. Pat. No. 5,216,620, supra, discloses a system and method whereby mail that is not addressed locally is conveyed by a mailer to a common carrier. In so doing, the mailer discloses to the local post office information relative to the mail with regard to the number of trays of mail, their weight, their distinction and information that may allow the mailer to receive a postal discount for his mail. Upon receipt of the information, the post office would then determine the cost of air freight for the mail which is looked upon by the common carrier as bulk freight.

Although the concepts described in these patent applications addressed areas where implementation of activities on the part of the mailer would benefit the post office, there are still many areas where the amount of effort required by the post office can be reduced.

In the processing of mail previously, non local mail processed by a mailer so as to obtain postal discounts was still sent to the local post office. This procedure was addressed by U.S. Pat. No. 5,216,620, supra. Although such system functioned well, it still required communication with a local post office and relied upon the post office for to flight information. There was no correlation between the destination of the mail being processed and the time of flight for such destination.

SUMMARY OF THE INVENTION

A scheme has been devised whereby a mailer processes mail in such a way that mail which is not addressed locally is conveyed to a common carrier in sufficient time to be placed on the next transportation vehicle without spending unnecessary time waiting to be loaded onto such vehicle.

The mail is processed by the mailer in such a way that non local mail is sorted in accordance with the zip codes for the distribution centers to which the non local mail is to be sent. The mail is placed into trays and the trays are labeled so as to indicate the contents of the tray. The trays with non local mail are then placed individually into sleeves and weighed, after which a tag is printed indicating the weight of the sleeved tray and its contents. A destination and routing tag is then applied to the sleeve, this tag is scanned and the information on the tag is up-loaded to the data processor of the mailer.

The data processor of the mailer not only contains mail lists and postal rate data, but data relative to time and destination of flights upon which mail can be placed for conveyance of a common carrier for delivery to a postal distribution center and the critical entry time for each postal distribution center. The critical entry time is the time of day by which it must be received by the postal distribution center to assure delivery by the next day.

The data processor of the mailer is programmed so that there is a correlation between the destination of the mail and the time of departure by the common carrier for such destination. The amount of postage to be charged to the mailer, the destination of the mail and the amount required to be paid to the common carrier for transporting the mail can all be determined by the mailer. After the trays are tagged and scanned, they are placed into receptacles and transported to the common carrier in accordance with the available flights so that the mail for a particular flight arrives at the common carrier just-in-time to be placed upon a transportation vehicle. Based upon the information received from the mailer, the post office charges the mailer the required postage for the mail without having to process any non local mail in a local post office.

DETAILED DESCRIPTION OF THE PREFERRED EMBODIMENT(S)

In order to reduce the amount of mail that is sent to a local post office for processing, eliminating the requirement of mail sorting by postal authorities at the location of a common carrier, and providing just-in-time delivery of mail to a common carrier, apparatus and method have been conceived whereby non local mail is processed by a mailer and forwarded directly to a common carrier in a just-in-time manner. Just-in-time as used in the instant invention is defined as coordinating the processing of mail in accordance with the destination of that mail and the departure time of a common carrier for such destination so that the mail is received by the common carrier in time to be placed on a transportation vehicle without spending unnecessary time at the common carrier location. Sufficient information is given by the mailer to the post office that allows the post office to determine if proper postage has been paid by the mailer and to verify the mail content and mail is sorted by the mailer in accordance with the postal distribution center destination. In an alternative embodiment, the common carrier can be paid directly by the mailer although present practice is to have the post office pay common carrier fees.

A prior scheme involved having the mailer sort his mail and contact the post office upon completion of the sorting. The post office would give the mailer the time of departure for the next transportation vehicle that would leave for the destination of such mail. By transportation vehicle is meant an airplane, truck, or whatever form of transportation a common carrier would use. For remote destinations the transportation vehicle is invariably an airplane; consequently, throughout this disclosure the transportation vehicle will be referred to as an airplane.

The shortcoming of the prior practice was that mailing lists are normally in numerical order according to the zip code and there is no relationship to the schedules of the common carrier. For example, the first mail being processed by the mailer may be addressed to the state of Maine whose zip code (first two digits) is 03. The first plane departure for the common carrier may be California, zip code 92, and the flight for Maine may be many hours away. Clearly, under these circumstances it would be advantageous to process the mail for California first and the mail for Maine at a later time in accordance with the next flight departure for that state.

Figure 1:
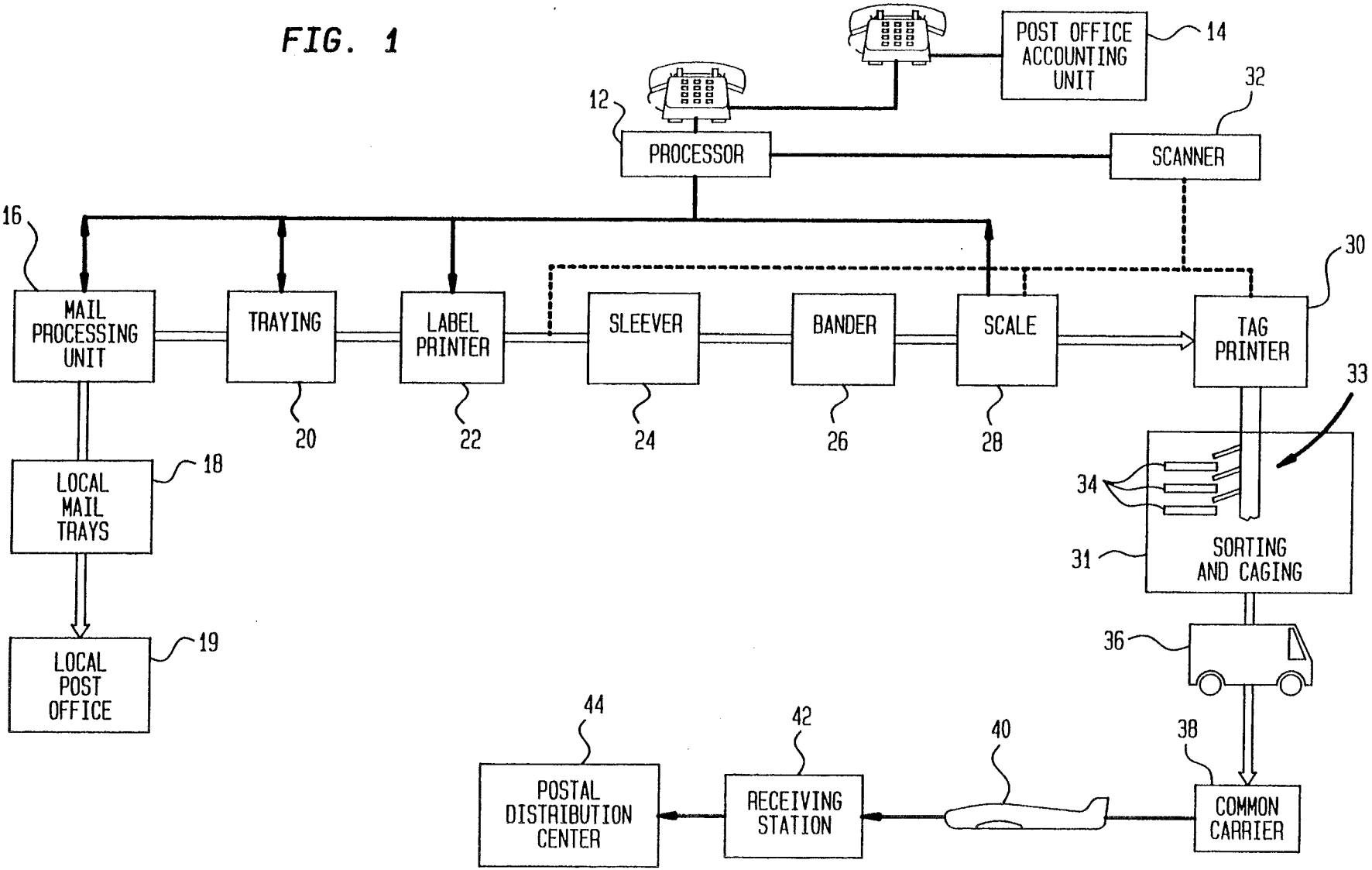
FIG. 1 is a block diagram of a system in which the preferred embodiment of the invention can be performed.

With reference to FIG. 1, a block diagram is shown representing a system capable of practicing the preferred embodiment of the invention. The system includes a mailer's data processor 12 that can be any one of a number of commercially available computers such as an IBM Compatible PC 386. This processor 12 is in selective communication with an accounting unit 14 of the post office and performs accounting functions for the post office which will be described hereinafter.

In FIG. 1, the conveyance of mail is indicated by double lines, communication lines are indicated by single lines and optical paths by dotted lines. Although the conveying devices for conveying items from one unit to another are not described, it will be appreciated such devices are well known in the art and of themselves do not form part of the instant invention except to the extent required to perform the novel concepts disclosed herein.

The mailer's data processor 12 is in communication with a mail processing unit 16 that is a combination of an inserter, such as a Model Series No. 8100 Inserter, available from Pitney Bowes Inc., and a sorter that sorts mail in accordance with zip codes. Inserters of this type have a processor that is programmed with a mailing list that includes the parties to whom mail is to be sent, the address and materials to be sent. Sorters are commercially available and are generally referred to as Optical Character Recognition (OCR) Channel Sorters. Alternatively, a bar code reader can be used if the mail has the Postnet bar code printed thereon. This mail processing unit 16 produces mail pieces, sorts such mail pieces and places the local mail into trays 18 that are sent to a local post office 19. It will be appreciated the post office accounting unit 14 and local post office 19 can be the same entity. The sorted, non local mail is trayed at a mail traying unit 20 in accordance with its zip code which, of course, represents the destination of the mail.

The mail processing unit 16 conveys information to the data processor 12 relative to the mail that is to be placed into trays and the data processor controls a label printer 22 for printing an appropriate mail destination label for each tray that is filled. The information conveyed to the processor 12 includes the class of mail and the calculated weight of individual mail pieces, based upon the number and kinds of inserts, so that the postage can be determined. The destination of the mail is also uploaded to the processor 12. Alternatively, such data could be resident in the memory of the processor 12. Thereafter, the labels on the trays are scanned and the trays then go through a sleever unit 24 wherein each tray is placed within a sleeve. The sleeved tray then is banded at a banding unit 26. What has been described heretofore has been disclosed previously, see for example U.S. Pat. No. 5,329,102, U.S. Pat. No. 5,119,306 and U.S. patent application Ser. No. 08/181,476, supra. These patent applications teach methods and apparatus for traying mail, labeling the trays, and providing information to the post office sufficient to authenticate payment of the mail.

After a label is attached to a tray, the label is scanned by a scanner 32 and the data therefrom is received by the processor 12 so that a verification can be made that the data on the label is correct. The processor 12 is programmed with the time of departure and destinations of airplanes upon which mail can be placed by a common carrier. The processor 12 will make routing decisions based upon stored information and the destination of the mail in the trays so that mail can be received by the common carrier just-in-time for a particular flight.

Downstream from the banding unit 26 is a scale 28 that weighs sleeved and banded trays of mail. Such weight determination will be uploaded to the data processor 12 to be used, in conjunction with the destination data, to calculate the transportation costs of the mail payable to the common carrier. A tag printer 30 is in communication with the processor 12 and is located downstream from the scale 28 for the purpose of printing a destination and routing tag for giving the common carrier routing information that had been determined by the processor 12. The tag produced by the tag printer 30 is attached to the tray sleeve and the scanner 32 will scan the tag for purposes of verification. The scanner 32 is in communication with the data processor 12 that receives the data from the scanner 30. The processor 12 will compare such data with prior data to assure correctness of the data on the tag. Downstream from the scanner 30 is a station 31 that includes loading apparatus 33 and a number of receptacle such as cages 34 in which trays are placed in accordance with the postal distribution center to which the mail is to be sent. The cages 34 can be any kind of movable container that will hold a large number of trays for subsequent conveyance.

The mail is accumulated in a cage 34, or cages, and retained until the appropriate time for conveyance to a common carrier as will be described hereinafter. The cage is sent to a transporting vehicle such, as a truck 36, where it is transported to the common carrier 38 just-in-time to catch the next flight. The truck 36 would be either a post office truck that is provided to large volume mailers or a truck that belongs to the common carrier or mailer. The common carrier 38, or postal authorities located at the common carrier, will not be required to sort the trays because of the prior processing by the mailer. The common carrier 38 will place the mail on other transport vehicles such as an airplane 40, train, truck or the like, which will deliver the mail to a receiving station 42 of a postal distribution center 44.

In operation, the processor 12 will have the routing and time of departure of the common carrier 38. The processor of the mail processing unit 16 will contain mailing lists for particular runs of mail, and will also have programmed therein the contents that are to be inserted into envelopes by the inserter of the mail processing unit 16 to form mailpieces. It will be appreciated that only one processor could be used, but in the preferred embodiment mail list and content information is in the processor of the mail processing unit 16 and the processor 12 will contain time of departure information that will be updated as schedules change. The inserter of the mail processing unit 16 will operate either under command of the data processor 12 or its internal processor and generate the mail pieces in accordance with a programmed mail list. The mail processing unit 16 will separate the local mail 18 from the non local mail during sorting, the latter being directed to the mail traying unit 20. After the mail is trayed in accordance with its destination, the label printer 22 will print a label 29 for the appropriate tray under control of the processor 12 in accordance with the information from the stored mail list. Reference can be had to U.S. Pat. No. 5,239,102, supra, for details as to the manner in which mailpieces are placed into trays in accordance with their zip codes and how the data processor coordinates the activities to assure that correct postage is paid, how the requirements of-the domestic mail manual are met with regard to postal discounts and how the label printer 22 prints an appropriate label that is placed in or received by a tray.

The labels on the trays are scanned by the scanner 32 and the labeled trays are placed into sleeves and banded by the sleever 24. The data resulting from the scanned label is received by the processor 12 and the data is forwarded to the post office 14. The tag will have specific information such as location of the postal distribution center 44 to which the mail is sent, the zip code thereof, the tray contents, and the identification of the mailer. It should be noted at this time that the label on a tray is primarily for the benefit of the mail receiving post office for purposes of further sorting and delivery and the tag on a sleeve is for the benefit of the common carrier 38.

A tray is placed into a sleeve and banded by the sleeving unit 24 and banding unit 26, respectively. A tag which is referred to as a a destination and routing tag, is printed and placed on the sleeve to provide information relative to the distribution center to which the mail is to be sent is identified. Before printing the tag however, the tray is weighed. This weighing by the scale 26 is for the purpose of determining the fee due to the common carrier for transporting the mail. Whereas the post office 14 receives the postage due from the mailer based upon individual mailpieces, the common carrier is paid in accordance with the bulk weight of the "freight" and its destination. The tag printer 30 will print the tag under control of the processor 12 that has data resulting from scanning of the tray label, weighing of the tray and destination and routing information. The data printed on the tag will show the destination of the tray as well as the contents of the tray and the weight. All this data can be included in bar code format so that the information can be derived quickly using a bar code scanner. After the tag has been scanned by the scanner 32, the trays are sent to the sorting and caging station 33 where they are sorted in accordance with their ultimate destination, i.e. the postal distribution center 44 to which they are to be sent. After sorting, the trays are placed into cages 34. These cages are then placed on transportation vehicles 36. Thereafter, the cages are sent to a common carrier 38 just-in-time to be placed upon the planes 40 to be sent to a receiving station 42 of a postal distribution centers 44 prior to the critical entry time (CET) which is the latest time mail can be received for next day delivery. At the postal distribution center 44, the mail will be distributed to local post offices for finer sortation and delivery.

It will be appreciated that with pre-sort software, computer records can be altered into a convenient zip code sequence before mail pieces are created in order to have just-in-time delivery of the mail pieces to the common carrier. Such a sequence can be created by processing an entire mailrun and supplying information of such mail run to the processor 12 through use of the scanner 32. After an entire run is complete, the processor 12 will re-arrange the sequence of the zip code runs by the mail processing unit 16 to correspond to the time of departure data resident in the processor 12.

Figure 2:
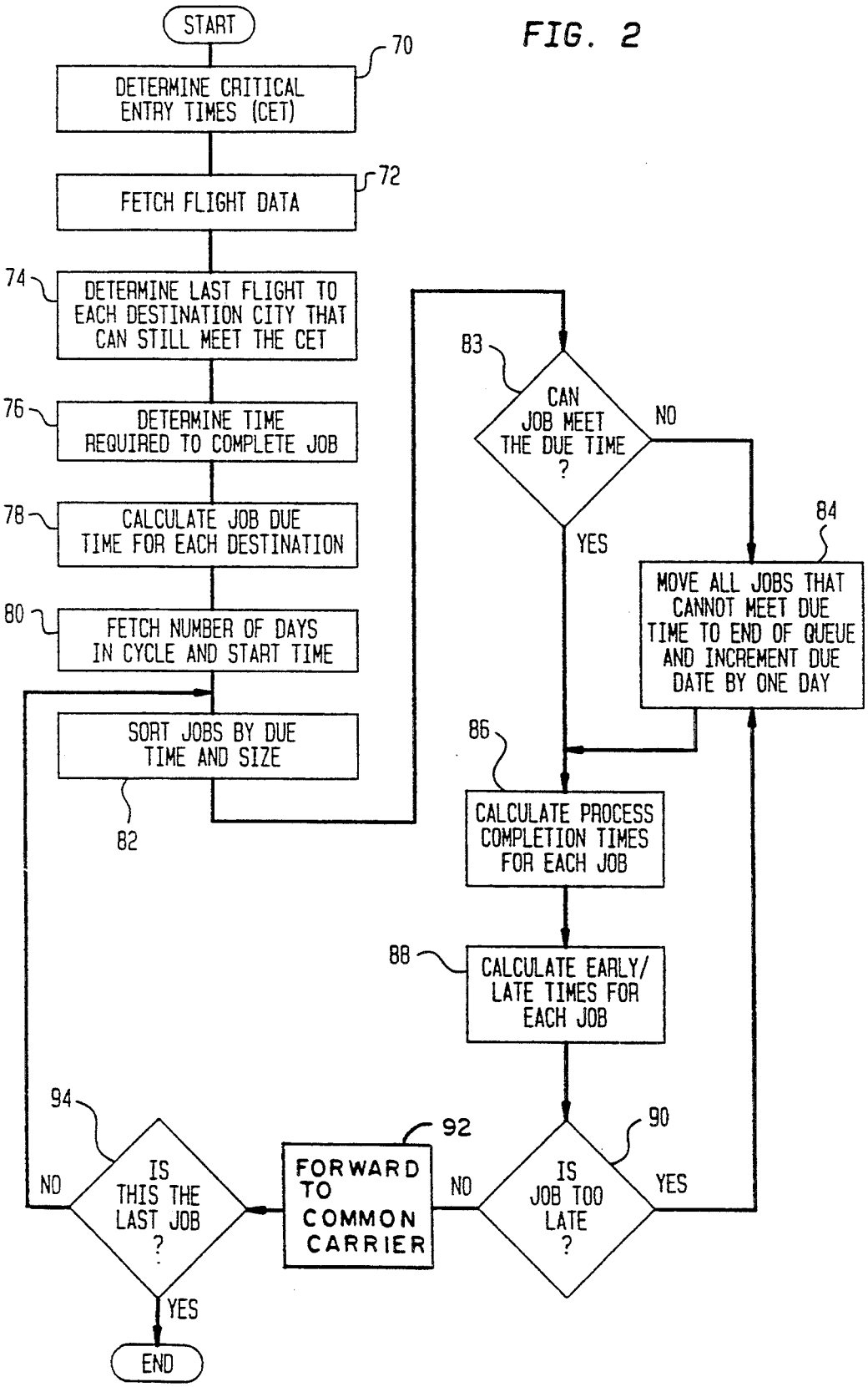
FIG. 2 is a flow chart illustrating a program for just-in-time mail delivery of mail.

With reference to FIG. 2, a description of the just-in-time program of the processor 12 is given. The critical entry times (CET) for each postal distribution center 44 is fetched 70. This CET data is supplied by the post office and uploaded to this processor 12. The flight data is fetched 72. A determination is made 74 of the last flight to each postal distribution center 44 that can still meet the critical entry times. The time required to complete jobs based upon the number and kinds of mail pieces is determined 76, the time a job is due at the common carrier is calculated 78 for each job.

The number of days in each job cycle and the job start time are fetched 80 and together with the calculated due time, jobs are scheduled in accordance with the due time and size thereof 82 so as to meet the just-in-time requirement. An inquiry is made 83 whether the job being processed can meet the due time at the common carrier, which will give the common carrier time to process and deliver the mail in time to meet the CET.

All jobs that cannot meet the due time are placed at the end of the queue and the due date for such jobs is incremented by one day 84. For those jobs that can meet the due time, a calculation is made 86 of the time required to complete each job. Thereafter, early/late times are calculated 88 for each job, which is the due time minus the completion time required by the mailer. An inquiry is made whether the early/late times is too late for that day 90. If yes, the job is moved to the end of the queue and incremented one day 84. If the inquiry is no, the job is forwarded to the common carrier 38 and an inquiry is made whether this is the last job 94. If no, the mail processing continues for the next job, but if yes, the mail run is complete.

Thus, what has been shown and described is apparatus and method whereby a local post office need not physically receive the non local mail, need not provide flight data to the mailer on an on-going basis and receives the benefit of just-in-time performance. In this way, a large volume of mail need not be handled by a local post office and time and expenses are reduced.

The embodiments disclosed herein have been given by way of illustration only, and other embodiments of the instant invention will be apparent to these skilled in the art from a consideration of the description. Limitations on the instant invention are to be found only in the claims.

What is claimed is:

1. A system for the handling and processing of mail having a mailer sort mail in accordance with the zip code designation thereof, separating local mail from non local mail, traying the non local mail and providing mail destination data to the mail trays, comprising:

(a) microprocessor means for assembling, arranging, and processing zip code, sorting, routing, and time table data;

(b) means for determining the routing of the mail trays through a transportation system;

(c) means for determining the times of departures of the transportation system;

(d) means for determining if non local mail can be processed in time to meet the critical entry time of the postal distribution center of the mail destination;

(e) means for determining the cost of shipping the mail and paying the cost of transporting the non local mail to the common carrier;

(f) means for delivering non local mail to a common carrier in accordance with the times of departures of the transportation system in time to meet a departure sequence for the common carrier as determined by the routing of the mail; and (g) means for notifying a postal authority of said processing of said non local mail so that said postal authority can charge said mailer for said mail.

2. The system of claim 1 further including providing routing information to the trays.

3. The system of claim 2 further including making a determination if the mail trays to be sent by the common carrier to a given location can meet the due time of the common carrier for meeting a scheduled flight.

* * * * *